US010617198B1

(12) United States Patent
De Michele

(10) Patent No.: US 10,617,198 B1
(45) Date of Patent: Apr. 14, 2020

(54) CARRYING APPARATUS FOR USING ELECTRONIC DEVICES

(71) Applicant: Christopher J. De Michele, Venice, FL (US)

(72) Inventor: Christopher J. De Michele, Venice, FL (US)

( * ) Notice: Subject to any disclaimer, the term of this patent is extended or adjusted under 35 U.S.C. 154(b) by 3 days.

(21) Appl. No.: 15/263,363

(22) Filed: Sep. 12, 2016

Related U.S. Application Data

(60) Provisional application No. 62/217,843, filed on Sep. 12, 2015.

(51) Int. Cl.
*A45F 5/00* (2006.01)
*B65D 25/20* (2006.01)

(52) U.S. Cl.
CPC ..... *A45F 5/00* (2013.01); *B65D 25/20* (2013.01); *A45F 2005/008* (2013.01)

(58) Field of Classification Search
CPC ..... A45F 5/00; A45F 2005/008; B65D 25/20
See application file for complete search history.

(56) References Cited

U.S. PATENT DOCUMENTS 6,330,961 B1 * 12/2001 Borja ..... A45C 1/04 224/221
8,662,362 B1 * 3/2014 Bastian ..... H04B 1/3888 224/197
9,464,755 B1 * 10/2016 Inman ..... F16M 13/02
9,587,783 B2 * 3/2017 Kofler ..... B62J 11/00
2004/0262342 A1 * 12/2004 Pringle ..... A45F 5/00 224/221
2012/0138647 A1 * 6/2012 Norling ..... A45F 5/00 224/267
2012/0217275 A1 * 8/2012 Yu ..... A45F 5/00 224/267
2012/0255978 A1 * 10/2012 Williams ..... A45F 5/00 224/219
2012/0307506 A1 * 12/2012 Gunn ..... F21L 4/005 362/382
2013/0277991 A1 * 10/2013 Wu ..... A45F 5/00 294/25
2015/0001290 A1 * 1/2015 Tovar ..... G06Q 20/34 235/380
2015/0288406 A1 * 10/2015 Haymond ..... H04B 1/3888 455/575.6

* cited by examiner

*Primary Examiner* — Anthony Stashick
*Assistant Examiner* — James Way

(57) ABSTRACT

The present invention provides convenient means to hold and carry personal electronic devices in an apparatus of flexible, semi-flexible, elastomeric, or bi-directionally elastic material incorporating a first opening sized to fit closely over an object or one end of one object, and a second opening sized to fit over an object or a second end of an object, and between the two openings, integral slots or straps to fit over ends or corners of a functional component such as a Personal Mobile Electronic Device (PMED) while securing the PMED to the apparatus with lateral and longitudinal tension so as to hold and carry the device being secured to the object.

17 Claims, 6 Drawing Sheets

CARRYING APPARATUS FOR USING ELECTRONIC DEVICES

CROSS-REFERENCE TO RELATED APPLICATIONS

The present application claims priority of U.S. Provisional patent application No. 62/217,843 filed on Sep. 12, 2015 the contents of which is herein incorporated by reference.

FIELD OF INVENTION

The present invention relates generally to handheld and portable electronic devices and more particularly, to convenient means for carrying and using such devices.

BACKGROUND OF THE INVENTION

Throughout most of the world, Personal Mobile Electronic Devices (PMEDs) are ubiquitous, in use for communications, creating, recording or distributing data and content. (i.e. phones, tablets, cameras, audio recorders, scanners, printers, etc.). As the usage of mobile, handheld devices skyrockets, so does the variety of device options, shapes and sizes.

One of the common and rising challenges of using handheld PMEDs is the desire for immediate access and connectivity. Often we see people walking, driving, biking, hiking, eating, shopping, holding children, etc., while engaged in mobile conversations, texting, and content, etc. These increasingly connected mobile activities occupy hands preferably devoted to the primary activity, and thereby compromise a person's ability to multi-task with safety, and efficiency. When not in use, carrying or holding PMED's can become inconvenient, uncomfortable, and at worst risky. Finding a suitable place to carry keys, credit cards, cash, identification, and a phone in a typical pair of pants/shorts/skirts or athleisure wear often create bulk and discomfort. Those who carry a handbag often desire more convenient access to their device(s).

The products available for transporting PMEDs hands-free and within view are either holsters or armbands, typically designed to fit the exact size and shape for one specific device, typically requiring a new purchase for each new device. Statistically, holsters are most often used by men when working, but are less suitable for use during recreational or fitness activities, during which armbands are generally used. Armbands are typically made from elastic materials with a pocket designed to hold a specific device securely on the upper arm. In this location it can be awkward, sometimes even risky, to interface with the PED.

Thus there remains an unmet need for an apparatus to conveniently hold and carry functional components such as PMEDs or the like; that can be configured to hold any functional components such as PMEDs or the like irrespective of manufacturing platforms with little to no modifications being necessary for the apparatus; which provides ready access, easy installation, removal, and use of the functional component in relation to the apparatus; an apparatus as stated herein which does not rely on gravity or magnetics for retention of the device; and an apparatus that is simple to manufacture and inexpensive. Thus, there remains an unmet need.

SUMMARY OF INVENTION

The present invention provides new benefits and solves a number of issues through its unique and material usage, delivering PMED accessibility and security in a lightweight aesthetic pleasing form acceptable for any casual or dressy, passive or active lifestyle situation. The inventive apparatus includes, at least, a proximal end and a distal end for securing the apparatus to an object. The intermediate extent formed between the proximal end and the distal end includes a plurality of openings, cut-outs, or pockets for securing a functional device or PMED to the apparatus. Some embodiments of the present invention are cut or molded as a flat sheet of flexible, semi-flexible, elastomeric, or bi-directionally elastic material incorporating a first opening sized to fit closely over an object or one end of an object and a second opening sized to fit over another object or another end of an object. Other embodiments may be used to incorporate functional devices or PMED's which do not necessarily have corners, but nonetheless similar features maybe used.

BRIEF DESCRIPTION OF THE DRAWINGS

For the present invention to be clearly understood and readily practiced, the present invention will be described in conjunction with the following figures, wherein like reference characters designate the same or similar elements, which figures are incorporated into and constitute a part of the specification, wherein.

DETAILED DESCRIPTION

Figure 1:
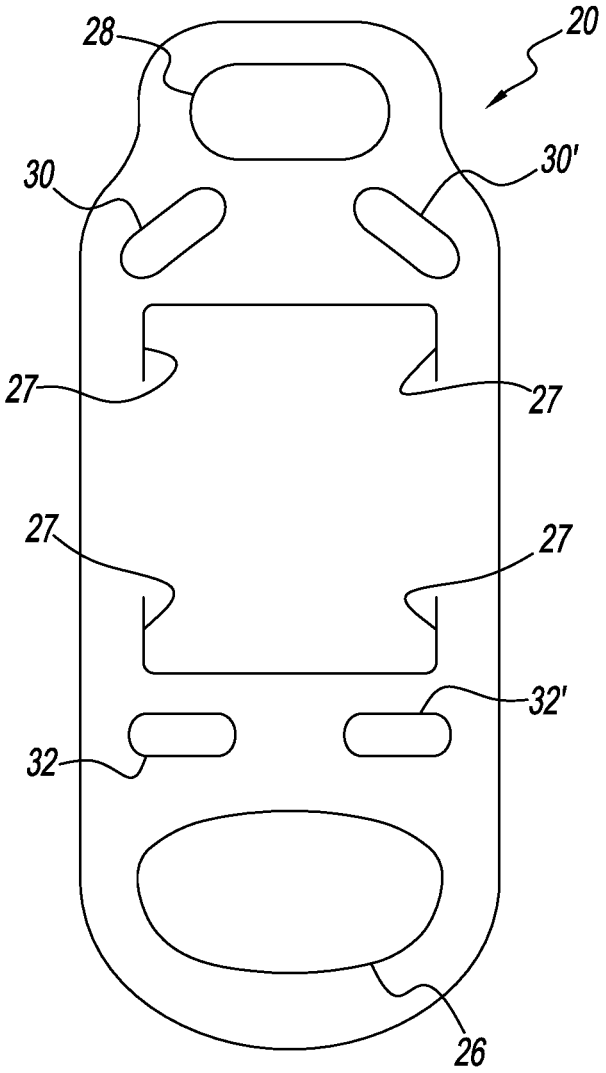
FIG. 1 shows a top view on the inventive apparatus 20, generally having a geometric shape and having lateral and longitudinal dimensions. A first opening 26 at the proximal end is sized and configured to fit closely over one object or one end of an object, while a second opening 28, at the distal end is sized and shaped to fit over another object or another end of an object. Between the first 26 and second 28 openings is an intermediate extent having a plurality of holding cut-outs 30, 30', and 32, 32', configured and located laterally and longitudinally in generally about the intermediate extent of the apparatus forming generally a rectangular shape to receive a functional components such as a PMED. Cut-outs 30 and 32 are located relative to cut-outs 30' and 32' so that material of the apparatus is tensioned therebetween when holding a functional component such as a PMED. In the same manner apertures 30, 30' are tensioned when holding a PMED. One or more flaps 27 may alternately be used in conjunction with Cut-outs 30, 30' and 32, 32' to assist in securing a functional component such as PMEDs to one or more objects or one or more ends of an object and further assist in providing longitudinal tension when holding a PMED.

The present invention provides for an apparatus for securing a functional component or Personal Mobile Electronic Device (PMED) to an object or to a human. The apparatus is intended to be made from a material having a proximal end and a distal end, each end having at least one hole for receiving at least one object or at least one end of an object. Between the proximal end and a distal end is an intermediate extent for securing a functional component or PMED to the apparatus, where the intermediate extent includes a plurality of cut-outs for receiving an end or a corner to a functional device or PMED. In at least one embodiment, the intermediate extent further includes one or more flaps to assist the plurality of cut-outs to securely fasten or engage the functional component or PMED to the apparatus. The inventive apparatus, thus allows for a functional component or PMED to be securely fashioned to one or more objects.

The following detailed description is merely exemplary in nature and is in no way intended to limit the scope of the invention, its application, or uses, which may vary. The invention is described with relation to the non-limiting definitions and terminology included herein. These definitions and terminology are not designed to function as a limitation on the scope or practice of the invention, but are presented for illustrative and descriptive purposes only.

It is to be understood that in instances where a range of values are provided that the range is intended to encompass not only the end point values of the range but also intermediate values of the range as explicitly being included within the range and varying by the last significant figure of the range. By way of example, a recited range from 1 to 4 is intended to include 1-2, 1-3, 2-4, 3-4, and 1-4.

As used herein "functional component" may mean any item that is intended to be held to an object such as a picture frame, notepad, a remote control, or an electronic device, and including Personal Mobile Electronic Devices (PMEDs)

As used herein "Personal Mobile Electronic Devices" or "PMEDs" shall mean any portable or mobile electronic device known in the art, including, but not limited to a smartphone, a portable music player, a tablet, a phone, a portable mini-computer, a portable display, a portable speaker, a portable scanner, a portable keyboard, or combinations thereof.

As used herein a "material" is intended to mean any material known in the art, and nothing herein is intended to limit the materials which can be used in any embodiment of the present invention. Suitable materials are flexible, semi-flexible, elastomeric, or elastic (omni-directional, bi-directionally, or unidirectional). Suitable materials include, but shall not be limited to, latex, silicone, neoprene, leather, rope, chord, elastic, rubber (synthetic or natural), nylon, flexible conduit, low density polyethylene, polypropylene plastics, or combinations thereof.

As used herein "geometric shape" is intended to mean any shape known in the art such as circular, oval, square, rectangular, trapezoidal, combinations thereof, or the like. Nothing herein is intended to limit the general shape of the apparatus or the shape of the functional devices.

Proximal and Distal Ends

The present invention provides an apparatus formed of a material having at least a proximal end and a distal end and an intermediate extent therebetween, which when used the apparatus is intended to secure a functional component, such as a Personal Mobile Electronic Device (PMED) to an object, objects, or to ends of an object. Particularly, the proximal and distal ends are intended to secure the apparatus to an object, objects, or over the ends of an object. The proximal and distal ends each include at least one hole. It should be appreciated that the hole is intended to allow the apparatus to fit an object, objects, or to ends of an object. In some embodiments, the holes may be sized or configured to fit over any object, while in other embodiments, the holes may be sized or configured to fit over a particular object or objects. While not absolutely necessary, and without being bound by any particular theory, it is intended that when the proximal end and distal end have engaged an object, a tension of opposing forces is created through the intermediate extent.

Many suitable objects for the intended purpose of the inventive apparatus are known in the art. Without intending to limit the invention, objects or ends of object may include human extremities such as hands, wrists, forearms, biceps, feet, legs, or combinations thereof. Alternately objects may include an animate or inanimate object. Again, without intending to limit the invention, such animate or inanimate objects may include bottles, exercise equipment, poles, or combinations thereof.

In at least one embodiment, the proximal end or the distal end includes a plurality of holes. In such embodiments the holes may be configured for receiving a plurality of objects, or be configured to receive one or more bands or straps to assist in securing the apparatus to one or more objects. As a non-limiting example, in at least one embodiment where the apparatus is intended to be worn on the hand of a human, the proximal end of the inventive apparatus includes a plurality of holes to receive a wristband to secure the proximal end of the apparatus to the wrist of the user.

Intermediate Extent

The intermediate extent of the inventive apparatus is intended to secure the functional component or PMEDs to the apparatus, while the apparatus is secured to the object. As discussed above, and again without being bound to any particular theory, in some embodiments a tension through the intermediate extent is created when the proximal end and distal end are engaged with an object. In some embodiments, the tension created assists the intermediate extent to securely hold a functional component of PMED snugly to the apparatus. As a result, personal items such as credit cards, paper money, or identification may be stored between the object and the apparatus.

The intermediate extent includes a plurality of openings or cut-outs for securing a functional device or PMED's to the apparatus. In at least one embodiment, the plurality of cut-outs in the intermediate extent allow for each end or for each corner of the functional device or PMED to be tucked into. In at least one embodiment, at least four (4) cut-outs for an intermediate extent exist, two (2) of which spaced adjacent to each other nearing the proximate end, and two (2) of which spaced adjacent to each other nearing the distal end. In some embodiments the plurality of cut-outs are parallel, while in other embodiments, the plurality of cut-out may be perpendicular or off-axis from each other. Nothing herein is intended to limit the orientation of any of the cut-outs to one another. In at least one embodiment, and without being bound by any particular theory, the intermediate extent is elastically isolated as a result of employing transverse cut-outs. It is appreciated that functional devices come in many shapes. In some embodiments, the cut-outs are alternatively pockets for holding a functional device or PMED.

One unique aspect of the present invention is that in at least one embodiment, the securing of the functional device and PMED in the intermediate extent, by virtue of the flexibility or elasticity of the material selected for its construction, and also as a function of the size of the functional device and PMED being secured to the intermediate extent, a lateral and longitudinal tension is created within the intermediate extent this positively engaging the functional device or PMED to the apparatus. In some embodiment, this lateral and longitudinal tension in addition to the additional longitudinal tension created by the proximal end and distal end in some embodiments, provide a surprising result, in that the functional device or PMED is secured tighter to the object giving the appearance of a degree of rigidity. It is appreciated that the amount of lateral and longitudinal tension may be modified by adjusting the tension across the intermediate extent by either adjusting the position and sizes of the cut-outs, or by adjusting the position and sizes of the holes in the proximal and distal ends.

Figure 3:
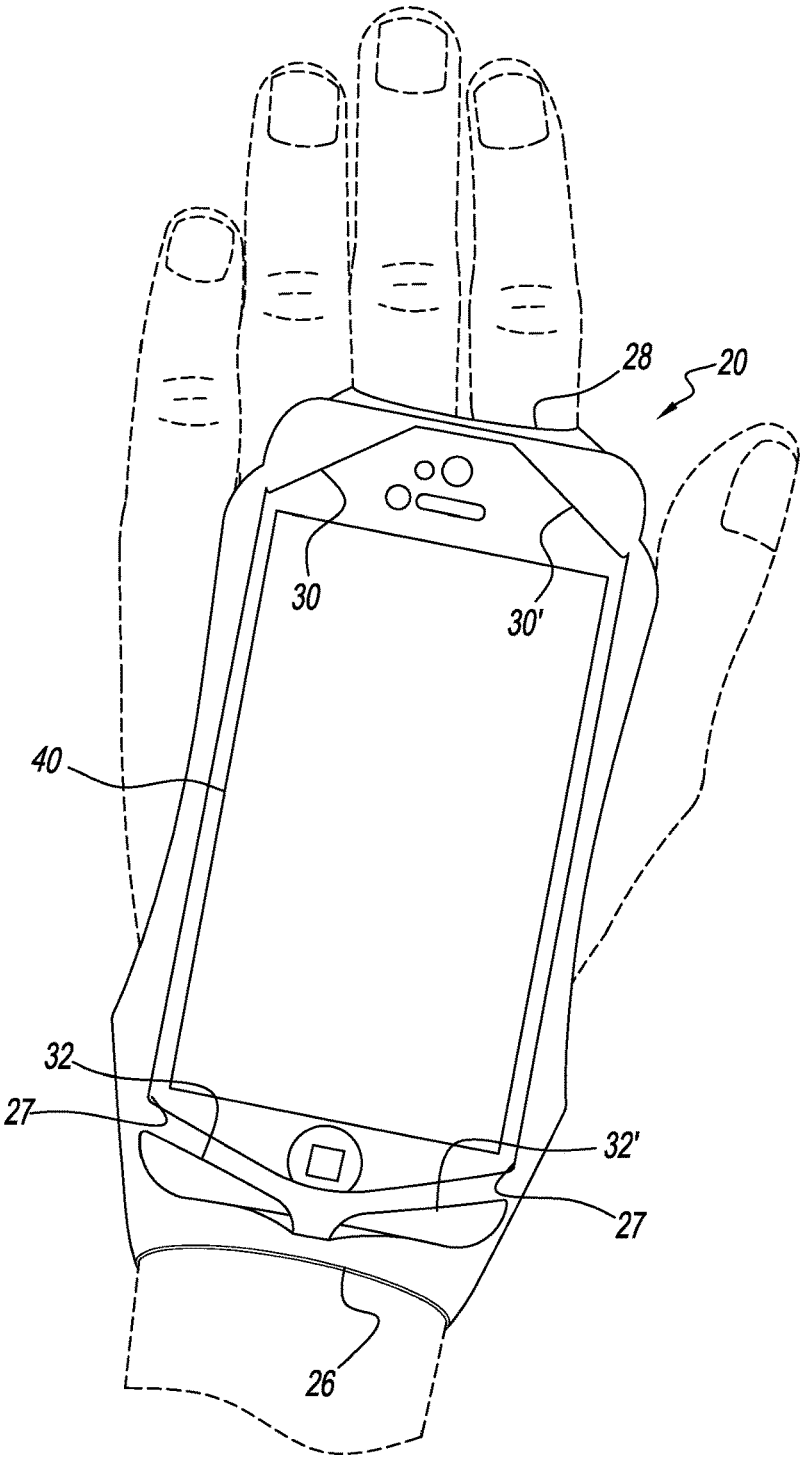
FIG. 3 shows a top view of at least one embodiment of the inventive apparatus 20 being used to secure a functional component such as a PMED 40 to a user's hand and wrist. In this embodiment, a PMED 40 is inserted into the flap 27 with the respective ends of the PMED 40 protruding through the cut-outs 32, 32', while apertures 30, 30' are fitted over the corners of the other end of the PMED 40.

In some embodiments, the intermediate extend further includes one or more flaps for working in conjunction with the one or more cut-outs to secure the functional device or PMED's to the apparatus. In at least one embodiment, the flaps are partial cut-outs or slits within the material of the apparatus and remain substantially connected to the apparatus, but a portion of which may be moved independent of the apparatus material. In some embodiments, the flaps may alternatively be incorporated with one or more openings. Without being bound by any particular theory, the use of the flaps in conjunction with the cut-out provides additional tension across the intermediate extent, and also positively engages the functional device or PMED by virtue in which the flaps are used in conjunction with the functional device or PMEDs. In at least one embodiment, the functional device or PMED is routed into the one or more flaps, and protrudes back through the one or more of the plurality of cut-outs in the intermediate extent. Without intending to be limited, one non-limiting example provides one-embodiment of the inventive apparatus where the corner of a PMED is pushed through the flap, momentarily coming in contact with the object that the apparatus is secured to, and then protruding out from the cut-outs. FIG. 3 provides at least one illustration of this particular embodiment. It is appreciated that all, some or none of the sides or edges may dually use the flaps and cut-outs in one or more embodiments.

EXAMPLES

It is to be understood that while the invention has been described in conjunction with the detailed description thereof, the foregoing description is intended to illustrate and not limit the scope of the invention, which is defined by the scope of the appended claims. Other aspects, advantages, and modifications are within the scope of the following claims.

Example 1

An apparatus 20 as shown in FIG. 1 is provided having a substantially rectangular shape and having lateral and longitudinal dimensions. The apparatus includes a proximal end having a first opening 26 and the distal end includes a second opening 28. Between the first 26 and second 28 openings is an intermediate extent having four cut-outs 30, 30', and 32, 32', configured and located laterally and longitudinally in generally about the intermediate extent of the apparatus forming generally a rectangular shape to receive a functional component such as a PMED. Cut-outs 30 and 32 are located relative to cut-outs 30' and 32'. The apparatus further includes two flaps 27 intended to be used in conjunction with cut-outs 30, 30' and 32, 32'.

Figure 2:
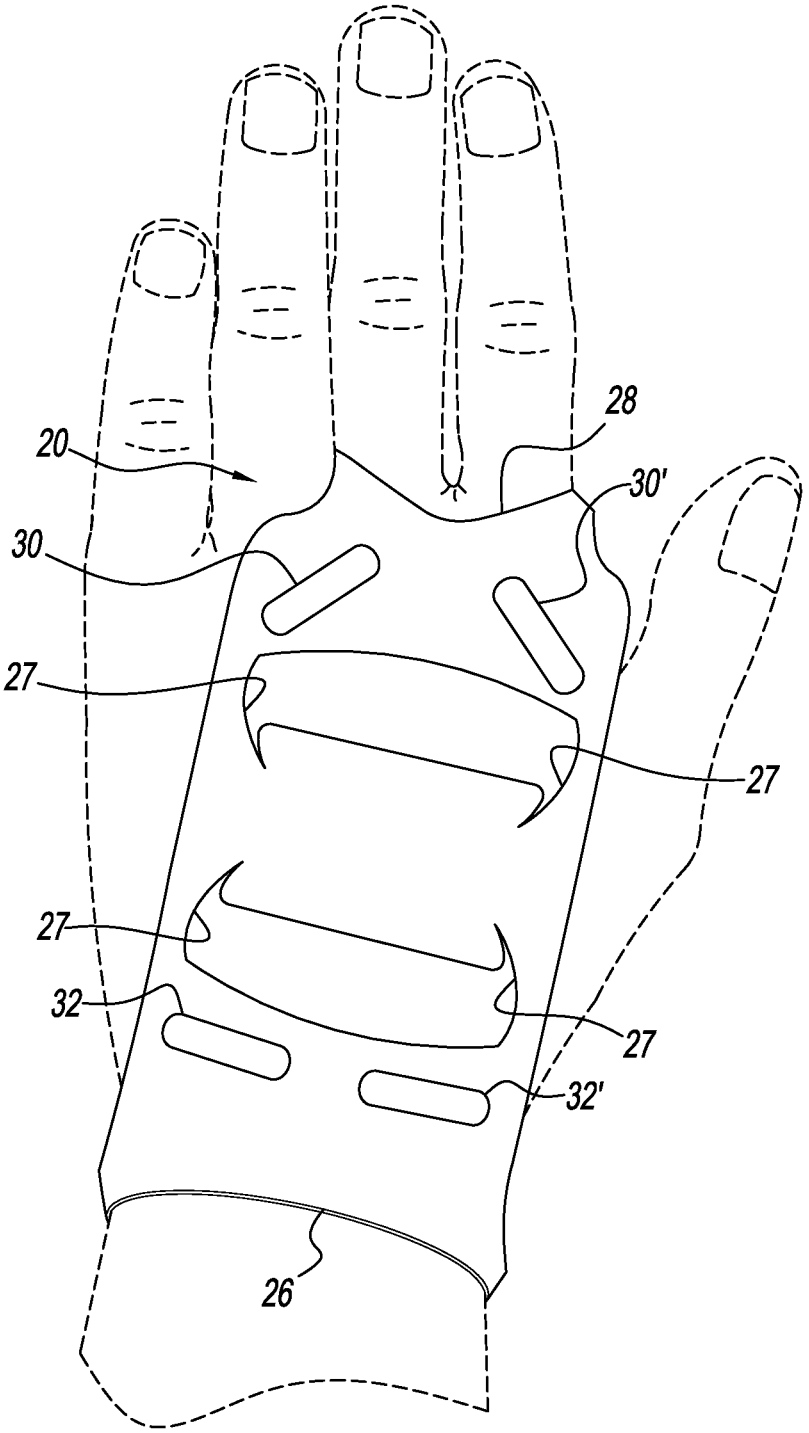
FIG. 2 shows a plan or top view of at least one embodiment of the inventive apparatus 20 being used to secure a functional component such as a PMED to one or more objects or one or more ends of an object, as illustrated where the object is a user's hand. First 26 and second 28 openings are seen to be fitted over the user's wrist and fingers respectively. While this view has opening 28 fitted over index and second fingers, it may be fitted over any one or more adjacent fingers.

A user inserts their hand through the first opening 26 and slides the first opening 26 to their wrist. The user then inserts at least two fingers into the second opening 28 located on the distal end, thus the intermediate extent extends across the back of a user's hand. FIG. 2 illustrates the user wearing this embodiment of the invention.

Figure 4:
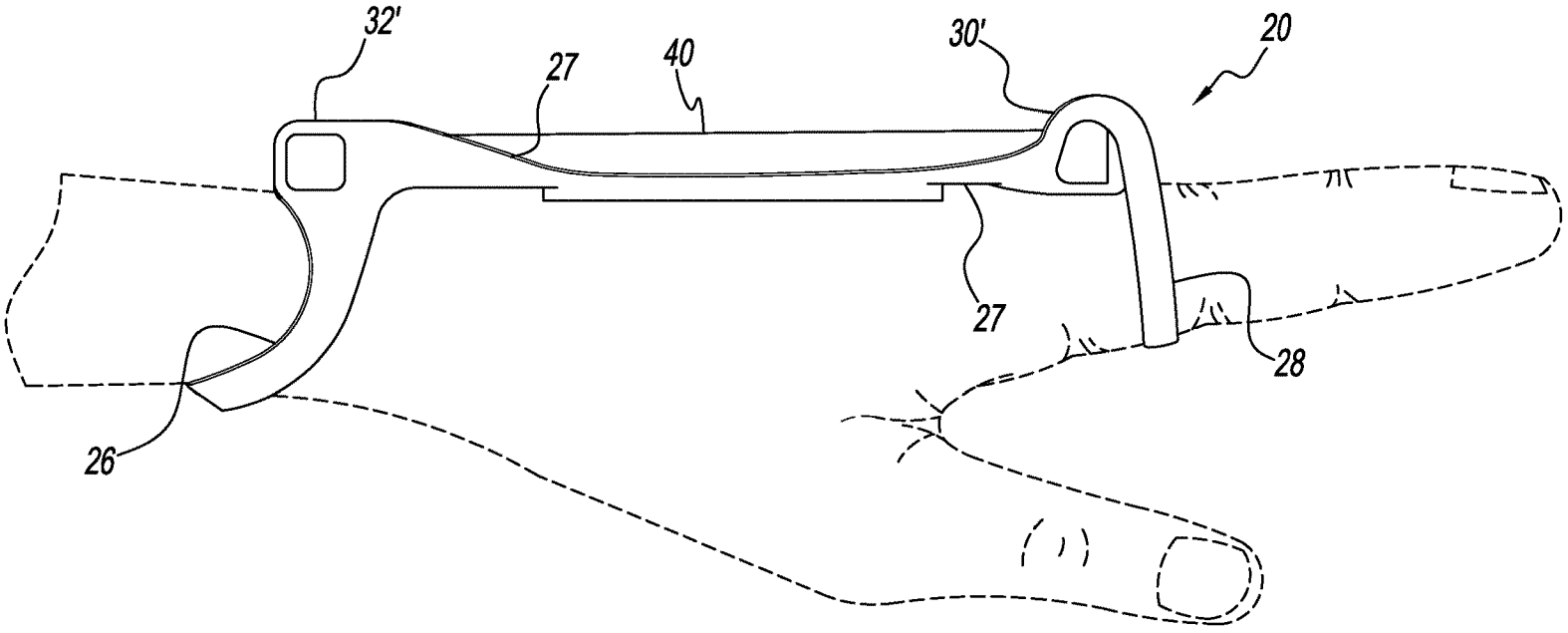
FIG. 4 shows a thumb side view of at least one embodiment of the inventive apparatus 20 being used to secure a functional component such as a PMED 40 to a user's hand and wrist. It should be appreciated that as configured, apertures 30, 30' are fitted over corners of PMED 40, while the opposite corners of the PMED 40 is routed into the flap 27 and inserted from bottom of the apparatus 20 out apertures 32, 32' to place the intermediate extent of the apparatus 20 in longitudinal tension.
Figure 5:
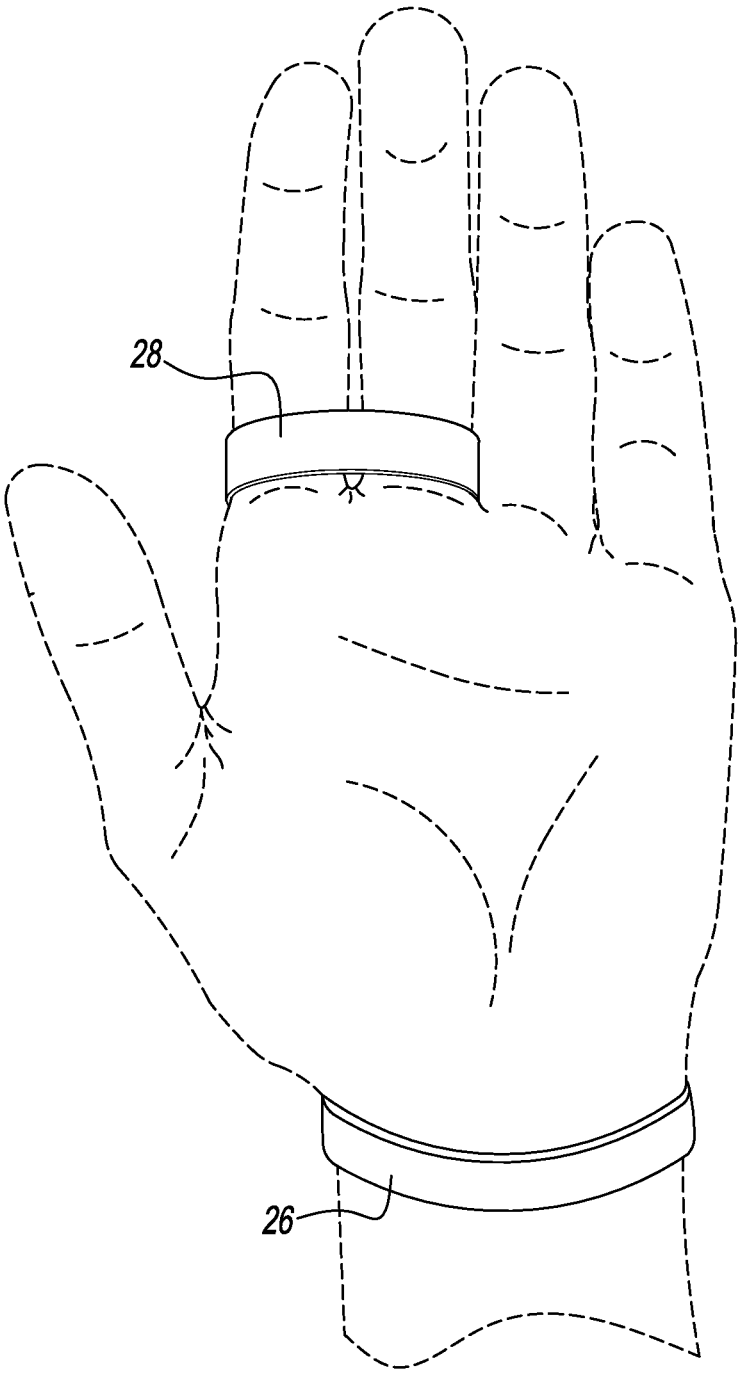
FIG. 5 shows a bottom or palm view of at least one embodiment of the inventive apparatus 20 being used to secure a functional component such as a PMED 40 to a user's hand and wrist. The PMED 40 is fitted to the apparatus 20 and as used in this embodiment, openings 26 and 28 fit over the user's wrist and an adjacent pair of fingers to hold, carry and use the PMED 40.
Figure 6:
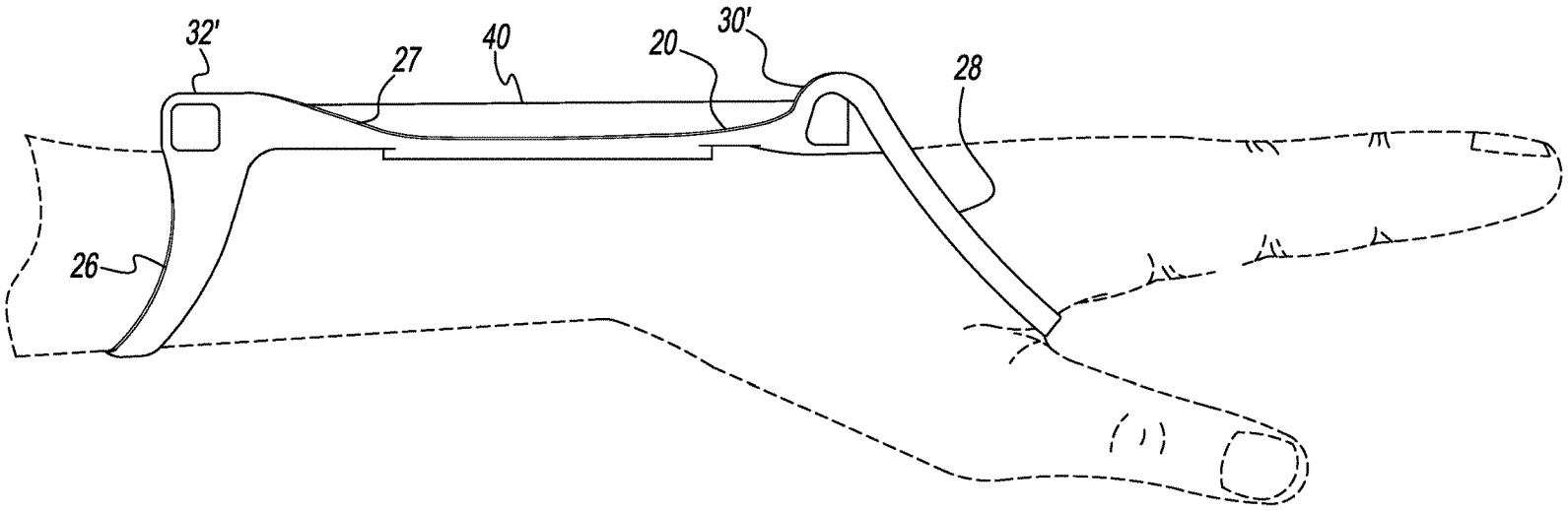
FIG. 6 shows a thumb side view of at least one embodiment of the inventive apparatus 20 being used to secure a functional component such as a PMED 40 to a user's hand and wrist. While similar to FIG. 4, the user's entire palm (excluding the thumb) is slid through the second opening 28, and the first opening 26 is slid further back on the user's wrist nearing the forearm.

The user then inserts their mobile smart phone 40 into the apparatus 20. In this instance the user inserts the bottom end of the phone through the flap 27 located near the first opening 26 adjacent to the wrist of the user, and slides the bottom corners back out through the cut-outs 32, 32'. Next, the user inserts the top end of the mobile smart phone 40 through the cut-outs 30, 30'. As a result of the lateral and longitudinal tension of the phone 40 in the cut-outs 30, 30' and 32, 32', in addition to the longitudinal tension imparted across the intermediate extent from the first opening 26 and the second opening 28, the mobile smart phone 40 is securely and firmly attached to the hand of the user. This use of the apparatus 20, is provided in FIG. 3, FIG. 4 and FIG. 5. The user continues to exercise and operate their phone as needed.

Example 2

The apparatus and use of Example 1 is repeated, however, instead of sliding the users fingers through the second opening 28, the entire palm (excluding the thumb) is slid into the second opening 28, while the first opening 26 is slid further back from the wrist providing the longitudinal tension across the intermediate extent. A mobile smart phone 40 is inserted in the apparatus 20, as described in Example 1.

Example 3

The apparatus and use of Example 1 is repeated, however, the apparatus does not include any 27 flaps, or in the alternative the user decides not to use the 27 flaps. In this example, the user slides the four corners of the mobile smart phone 40 into the respective cut-outs 30, 30' and 32, 32'.

Example 4

The apparatus and use of Example 1 is repeated, however, instead of sliding the users fingers through the second opening 28, the entire palm hand is is slid through the second opening 28, such that the second opening 28 is at the wrist of the user, while first opening 26 is slid further back nearing the elbow of the user, thus providing the longitudinal tension across the intermediate extent. A mobile smart phone 40 is inserted in the apparatus 20, as described in any of the preceding Examples.

Example 5

The apparatus and use of Example 1 is repeated, however, instead of sliding the users fingers through the second opening 28, the entire hand is slid through the second opening 28, such that the second opening 28 is at the wrist of the user, while first opening 26 is slid further back nearing the elbow of the user, thus providing the longitudinal tension across the intermediate extent. A mobile smart phone 40 is inserted in the apparatus 20, as described in any of the preceding Examples.

Example 6

The apparatus and use of Example 4 is repeated, however, instead of sliding the users fingers through the second opening 28, the entire forearm of the user is slid through the second opening 28, such that the second opening 28 is at the elbow end of the users bicep, while the first opening 26 is slid further back nearing the shoulder side of the user's bicep with the intermediate extent resting on the bicep of the user. A mobile smart phone 40 is inserted in the apparatus 20, as described in any of the preceding Examples.

Example 7

The apparatus and use of Example 4 is repeated, however, instead of using a body part, the user slides a top end of a water bottle through the first opening 26 through to the second opening 28, such that the second opening 28 is at the top end of the bottle, while the first opening 26 is near the bottom end of the water bottle, with the intermediate extent resting on the main portion of the water bottle. A mobile smart phone 40 is inserted in the apparatus 20, as described in any of the preceding Examples.

Example 8

The apparatus and use of Example 1 is repeated, however, instead of the first opening 26 having one hole, the first opening 26 has at least two holes. The user routes a wrist band through the two holes of the first opening 26, slides their fingers through the second opening 28, and secures the wristband around their wrist. A mobile smart phone 40 is inserted in the apparatus 20, as described in any of the preceding Examples.

Other Embodiments

While at least one exemplary embodiment has been presented in the foregoing detailed description, it should be appreciated that a vast number of variations exist. For example, some uses do not require both ends of the apparatus to be secured to an object, and the apparatus may be hung or dangled from one end of an object. It should also be appreciated that the exemplary embodiment or exemplary embodiments are only examples, and are not intended to limit the scope, applicability, or configuration of the described embodiments in any way. Rather, the foregoing detailed description will provide those skilled in the art with a convenient road map for implementing the exemplary embodiment or exemplary embodiments. It should be understood that various changes can be made in the function and arrangement of elements without departing from the scope as set forth in the appended claims and the legal equivalents thereof.

The invention claimed is:

1. An apparatus for securing a functional device, such as personal mobile electronic devices (PMED's), to an object, said apparatus comprising:

a single unitary piece of material having two ends for receiving at least one object or at least one end of an object, a proximal end and a distal end, and an intermediate extent therebetween;

said proximate end and said distal end having at least one hole for receiving at least one object or at least one end of an object; and said intermediate extent having a plurality of openings for securing a functional device to said material wherein said functional device is secured to said material as a result of the tension exerted on said functional device from inserting said functional device in to at least one of said openings.

2. The apparatus of claim 1 wherein said material is a flexible or semi-flexible material.

3. The apparatus of claim 2 wherein said flexible or semi-flexible material is latex, silicone, neoprene, leather, rope, chord, elastic, rubber (synthetic or natural), nylon, flexible conduit, low density polyethylene and polypropylene plastics.

4. The apparatus of claim 1 wherein said object or one end of an object is a hand, a wrist, a bottle, an forearm, a bicep, a foot, a leg, a can, or combinations thereof.

5. The apparatus of claim 1 wherein said proximal end or said distal end further comprise of a plurality of holes, which act as loops, for receiving and securing the apparatus to one or more wrist bands.

6. The apparatus of claim 1 further comprising one or more flaps for inserting at least one end of the object, thereby allowing the one end of the object to travel under the apparatus and out of the one or more cut-outs.

7. The apparatus of claim 1 wherein said plurality of holes of said intermediate extent includes one or more apertures, one or more cutouts, one or more flaps, or combinations thereof.

8. The apparatus of claim 1 wherein said proximal end includes an opening and is sized and configured to fit closely over said object or one end of said object.

9. The apparatus of claim 1 wherein said distal end includes an opening and is sized and configured to fit closely over said object or one end of said object.

10. An apparatus for securing a functional device, such as personal mobile electronic devices (PMED's), to an object, said apparatus comprising:

a single unitary piece of material having a proximal end, a distal end, and an intermediate extent therebetween;

said proximal end having at least one opening;

said distal end having at least one opening; and said intermediate extent having a plurality of openings for securing a functional device to said material wherein said functional device is secured to said material as a result of the tension exerted on said functional device from inserting said functional device in to at least one of said openings.

11. The apparatus of claim 10 wherein said material is a flexible or semi-flexible material.

12. The apparatus of claim 11 wherein said flexible or semi-flexible material is latex, silicone, neoprene, leather, rope, chord, elastic, rubber (synthetic or natural), nylon, flexible conduit, low density polyethylene and polypropylene plastics.

13. The apparatus of claim 10 wherein said object or one end of an object is a hand, a wrist, a bottle, an forearm, a bicep, a foot, a leg, a can, or combinations thereof.

14. The apparatus of claim 10 wherein said proximal end or said distal end further comprise of a plurality of holes, which act as loops, for receiving and securing the apparatus to one or more wrist bands.

15. The apparatus of claim 10 further comprising one or more flaps for inserting at least one end of the object, thereby allowing the one end of the object to travel under the apparatus and out of the one or more cut-outs.

16. The apparatus of claim 10 wherein said plurality of holes of said intermediate extent includes one or more apertures, one or more cutouts, one or more flaps, or combinations thereof.

17. The apparatus of claim 10 wherein said proximal end or said distal end includes a plurality of holes to receive a wristband to secure the proximal end or the distal of the apparatus.

* * * * *